US009598916B2

(12) United States Patent
Wood et al.

(10) Patent No.: US 9,598,916 B2
(45) Date of Patent: Mar. 21, 2017

(54) TOP DRIVE STAND COMPENSATOR WITH FILL UP TOOL

(71) Applicant: Weatherford Technology Holdings, LLC, Houston, TX (US)

(72) Inventors: Kevin Wood, Houston, TX (US); Jim Hollingsworth, Cypress, TX (US); Troy F. Hill, Lafayette, LA (US)

(73) Assignee: Weatherford Technology Holdings, LLP, Houston, TX (US)

( * ) Notice: Subject to any disclaimer, the term of this patent is extended or adjusted under 35 U.S.C. 154(b) by 554 days.

(21) Appl. No.: 13/953,128

(22) Filed: Jul. 29, 2013

(65) Prior Publication Data

US 2015/0027732 A1 Jan. 29, 2015

(51) Int. Cl.

| | |
|---|---|
| ***E21B 19/08*** | (2006.01) |
| ***E21B 19/16*** | (2006.01) |
| ***E21B 21/02*** | (2006.01) |
| ***E21B 19/07*** | (2006.01) |

(52) U.S. Cl.

CPC ..... *E21B 19/08* (2013.01); *E21B 19/07* (2013.01); *E21B 19/16* (2013.01); *E21B 21/02* (2013.01)

(58) Field of Classification Search

CPC ..... E21B 19/02; E21B 19/06; E21B 19/08; E21B 19/07; E21B 19/16; E21B 3/02

See application file for complete search history.

(56) References Cited

U.S. PATENT DOCUMENTS

| | | | | |
|---|---|---|---|---|
| 3,722,603 | A | 3/1973 | Brown | |
| 3,748,702 | A * | 7/1973 | Brown | E21B 19/10 188/67 |
| 5,036,927 | A | 8/1991 | Willis | |
| 5,297,833 | A * | 3/1994 | Willis et al. | 294/102.2 |
| 7,793,719 | B2 | 9/2010 | Snider et al. | |
| 8,141,642 | B2 | 3/2012 | Olstad et al. | |
| 8,356,674 | B2 | 1/2013 | Murray et al. | |
| 2002/0170720 | A1 * | 11/2002 | Haugen | 166/379 |
| 2003/0034157 | A1 | 2/2003 | Mullins | |
| 2005/0000691 | A1 * | 1/2005 | Giroux et al. | 166/291 |
| 2006/0124293 | A1 * | 6/2006 | Juhasz et al. | 166/77.1 |
| 2007/0131416 | A1 * | 6/2007 | Odell et al. | 166/250.1 |
| 2008/0264648 | A1 * | 10/2008 | Pietras et al. | 166/380 |

(Continued)

FOREIGN PATENT DOCUMENTS

| | | | |
|---|---|---|---|
| CA | 2741532 | A1 | 4/2010 |
| IL | 25639 | A | 2/1970 |

(Continued)

OTHER PUBLICATIONS

Australian Examination Report for Patent Application No. 2014206212 dated Jul. 24, 2015.

(Continued)

*Primary Examiner* — Robert E Fuller

(74) *Attorney, Agent, or Firm* — Patterson & Sheridan, LLP

(57) ABSTRACT

A compensation and fill up assembly comprises a slip assembly for engaging a tubular and a compensation assembly for supporting a weight of the tubular when engaged by the slip assembly. The compensation and fill up assembly further comprises a fluid swivel and a fill up tool coupled to the fluid swivel by a fluid shaft. The fill up tool is insertable into and rotatable with the tubular using the fluid swivel.

23 Claims, 15 Drawing Sheets

(56) References Cited

U.S. PATENT DOCUMENTS

| | | | | |
|---|---|---|---|---|
| 2009/0121507 | A1* | 5/2009 | Willis | 294/86.26 |
| 2009/0274545 | A1* | 11/2009 | Liess et al. | 414/800 |
| 2009/0314496 | A1* | 12/2009 | Begnaud et al. | 166/380 |
| 2010/0101805 | A1* | 4/2010 | Angelle et al. | 166/380 |
| 2013/0146304 | A1 | 6/2013 | Sonnier | |

FOREIGN PATENT DOCUMENTS

| | | | |
|---|---|---|---|
| WO | 2009/135223 | A2 | 11/2009 |
| WO | 2013/159202 | A1 | 10/2013 |

OTHER PUBLICATIONS

Canadian Office Action dated Jan. 4, 2016, for Canadian Patent Application No. 2,857,796.
Australian Patent Examination Report dated Jan. 29, 2016, for Australian Patent Application No. 2014206212.
Extended European Search Report for Application No. 14178414.0-1605 / 2832951 dated Nov. 2, 2015.

* cited by examiner

TOP DRIVE STAND COMPENSATOR WITH FILL UP TOOL

BACKGROUND OF THE INVENTION

Field of the Invention

Embodiments of the invention relate to methods and apparatus for making up tubular connections.

Description of the Related Art

In the construction and completion of oil and gas wells, a drilling rig is used to facilitate the insertion and removal of tubular strings into a wellbore. Tubular strings are constructed by inserting a first tubular into a wellbore until only the upper end of the tubular extends out of the wellbore. A gripping member close to the surface of the wellbore then grips the upper end of the first tubular. The upper end of the first tubular has a threaded box end for connecting to a threaded pin end of a second tubular. The second tubular is lifted over the wellbore center, lowered onto or "stabbed into" the upper end of the first tubular, and then rotated such that the pin end of the second tubular is threadedly connected to the box end of the first tubular.

This process may be repeated to form a tubular string of desired length. However, it is critical not to damage the threads when the pin end is stabbed into the box end, or when torque is applied to overcome the weight of the second tubular resting on the threads. It is also critical that the drilling rig operator lowers the second tubular at the same rate at which the threads draw together.

During make up of these tubular connections, the tubular string may be filled with a drilling fluid, such as mud. A fill up tool is inserted into the tubular string for supplying the drilling fluid. The fill up tool may include a sealing member, such as a packer, that engages the inner diameter of the tubular string to prevent drilling fluid from flowing out of the upper end of the tubular string. The sealing member, however, remains stationary as the tubular string rotates when making up a tubular connection and/or when being lowered into the wellbore. Wear of the sealing element is greatly enhanced by rotation of the tubular string relative to the stationary sealing element, which increases the risk of a seal failure.

Therefore, there is a need for new and improved methods and apparatus for making up tubular connections.

SUMMARY OF THE INVENTION

A compensation and fill up assembly, comprising a slip assembly for engaging a tubular; a compensation assembly for supporting a weight of the tubular when engaged by the slip assembly; a fluid swivel; and a fill up tool coupled to the fluid swivel by a fluid shaft, wherein the fill up tool is insertable into and rotatable with the tubular using the fluid swivel.

A method of making up a tubular connection, comprising lowering a compensation and fill up assembly into engagement with a tubular, wherein the compensation and fill up assembly comprises a slip assembly, a compensation assembly, a fluid swivel, and a fill up tool coupled to the fluid swivel by a fluid shaft; inserting the fill up tool into the tubular; engaging the tubular using the slip assembly; supporting a weight of the tubular using the compensation assembly; and rotating the tubular, the slip assembly, the fluid swivel, and the fill up tool to connect the tubular to a tubular string.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
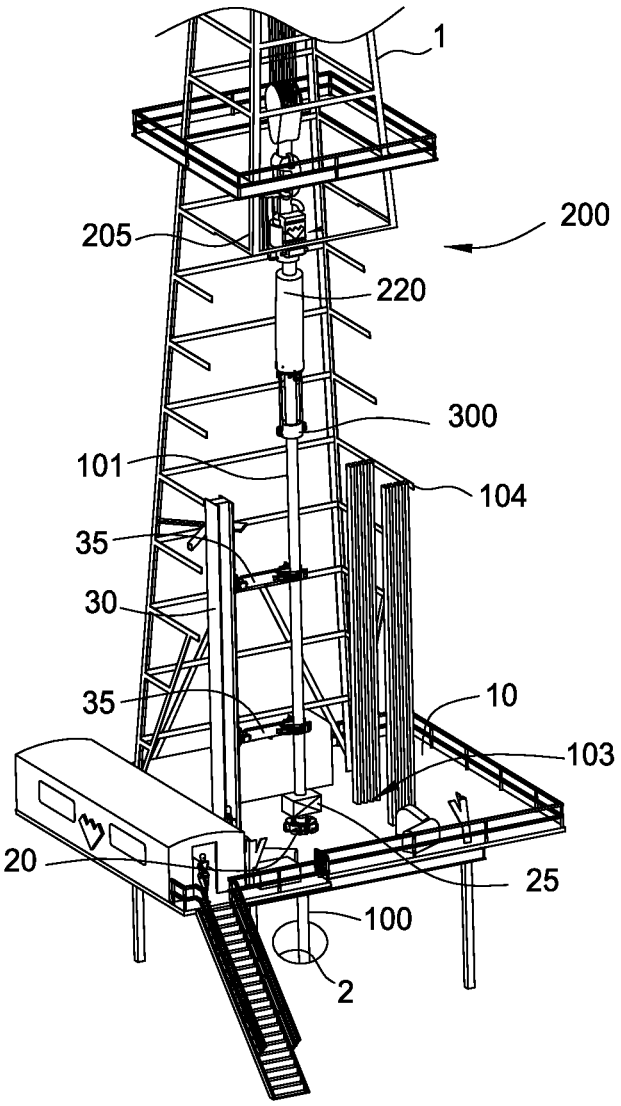
FIG. 1 illustrates a drilling rig system according to one embodiment.

FIG. 1 is a perspective view of a drilling rig 1 having a rig floor 10 with a gripping apparatus 20 located substantially at the center of the rig floor 10. The gripping apparatus 20 grips and supports the weight of a tubular string 100. The gripping apparatus 20 is typically a spider having slips, but can be any other similar apparatus configured to support the weight of the tubular string 100. The tubular string 100 comprises one or more tubulars, such as tubular 101 (having flush joints or tool joints), that are coupled together and subsequently lowered into a wellbore 2.

A handling system 30 having gripping members 35 is disposed on the drilling rig 1. The gripping members 35 may be operable to retrieve the tubular 101 from a stack of tubulars located on or near the drilling rig 1. The handling system 30 assists with positioning and/or connecting the tubular 101 to the tubular string 100.

A rotation mechanism 25 may be provided on the drilling rig 1 for rotating the tubular 101 and/or the tubular string 100. The rotation mechanism 25 rotates the tubular 101 to make up a threaded connection with the tubular string 100. The rotation mechanism 25 may be any apparatus for rotating a tubular, including but not limited to, a pipe spinner, a power tong, a pipe wrench, or a rotary table. Alternatively, or in addition to the rotation mechanism 25, the tubular 101 and/or tubular string 100 may be rotated using a top drive or a power swivel.

A tubular handling assembly 200 comprising a traveling member 205, a compensator/fill up assembly 220, and an elevator 300 may be supported by the drilling rig 1. The assembly 200 assists with the connection of one or more tubulars 101 to the tubular string 100. The traveling member 205 may be any device capable of raising and lowering the assembly 200, including but not limited to, a traveling block, a top drive, and/or an elevator. The compensator/fill up assembly 220 may be any device capable of compensating for the weight of the tubular 101 and/or filling up the tubular string 100 with a drilling fluid or other similar working fluid. The elevator 300 may be any device capable of supporting the entire weight of the tubular string 100.

In operation, the handling system 30 grips and positions the tubular 101 substantially over the well center, with a pin end 103 of the tubular 101 closest to a box end 104 of the tubular string 100. The traveling member 205 lowers the assembly 200 until the compensator/fill up assembly 220 engages the upper end of the tubular 101. With the compensator/fill up assembly 220 supporting the weight of the tubular 101, the tubular 101 is moved so that the pin end 103 engages the box 104 of the tubular string 100 for connection. During stab in and make up of the threaded connection between the tubular 101 and the tubular string 100, the compensator/fill up assembly 220 supports at least a portion of the weight of the tubular 101 to prevent and/or minimize the risk of the tubular 101 weight causing damage to the threads. By supporting at least a portion of the weight of the tubular 101, the compensator/fill up assembly also helps increase the amount of torque into making up the threaded connection by reducing the amount needed to overcome sliding friction when rotating the tubular 101.

In one embodiment, the rotation of the tubular 101 is performed by the rotation mechanism 25. The rotation mechanism 25 may be a power tong. With the tubular 101 rotating, and the compensator/fill up assembly 220 supporting and compensating the weight of the tubular 101, the pin 103 threads into the box 104. The elevator 300 may then engage the tubular string 100, which now includes the tubular 101. The compensator/fill up assembly 220 may disengage the tubular 101, and the gripping apparatus 20 may disengage the tubular string 100, such that the entire load of the tubular string 100 is supported by the elevator 300. Although not supporting the weight of the tubular string 100, the compensator/fill up assembly 220 may still be engaged with the tubular 101 to supply a drilling fluid or other working fluid to the tubular string 100.

The traveling member 205 lowers the tubular string 100 so that the box end 104 is near the rig floor 10. The gripping apparatus 20 then engages the tubular string 100 and the elevator 300 disengages the tubular string 100. The traveling member 205 lifts the assembly 200 and the process is repeated until the tubular string 100 is the desired length.

In one embodiment, the traveling member 205 may be a top drive which rotates the tubular 101 during connection such that the rotation mechanism 25 is not needed. As noted above, the traveling member 205 may be any apparatus for raising and lowering tubulars, including but not limited to, a top drive, an elevator, a traveling block, and/or any combination of similar systems known in the art. In one embodiment, the handling system 30 may not be used and the tubular 101 may be brought to the well center by the elevator 300, by manual operation, or by other means known in the art.

Figure 2:
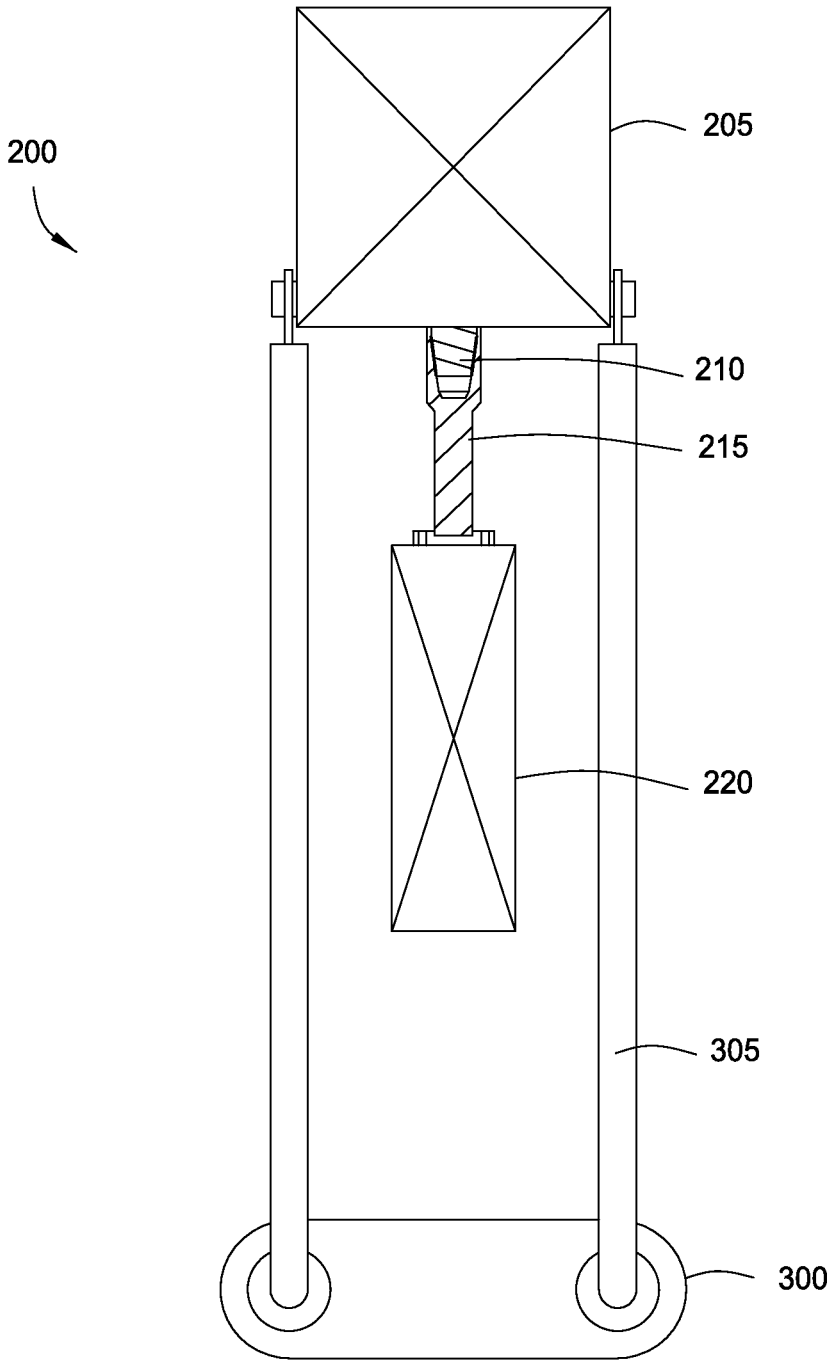
FIG. 2 illustrates a tubular handling system according to one embodiment.

FIG. 2 illustrates a schematic view of the tubular handling assembly 200. The assembly 200 may include the traveling member 205 which connects to the compensator/fill up assembly 220 and the elevator 300. An adapter sub 215 may connect the traveling member 205 to the compensator/fill up assembly 220. In one embodiment, the adapter sub 215 connects to a drive shaft 210 of the traveling member 205, which may be a top drive configured to rotate the tubular 101. The adapter sub 215 may have threads which screw onto the end of the drive shaft 210. Although shown as a threaded connection, the adapter sub 215 may connect to the drive shaft 210 in any manner known in the art, such as by welding, pin connectors, or clamps. The adapter sub 215 comes in any size desired to meet the requirements of the traveling member 205 and the drilling operation.

Further, the assembly 200 may include the elevator 300. The elevator 300 connects to the traveling member 205 by bails 305. The elevator 300 may be a tubular string elevator adapted to support the entire weight of the tubular string 100. The elevator 300 may be any elevator used in drilling operations, capable of supporting the weight of the tubular 101 or the entire tubular string 100. The elevator 300 may be automated for remote operation.

Figure 3:
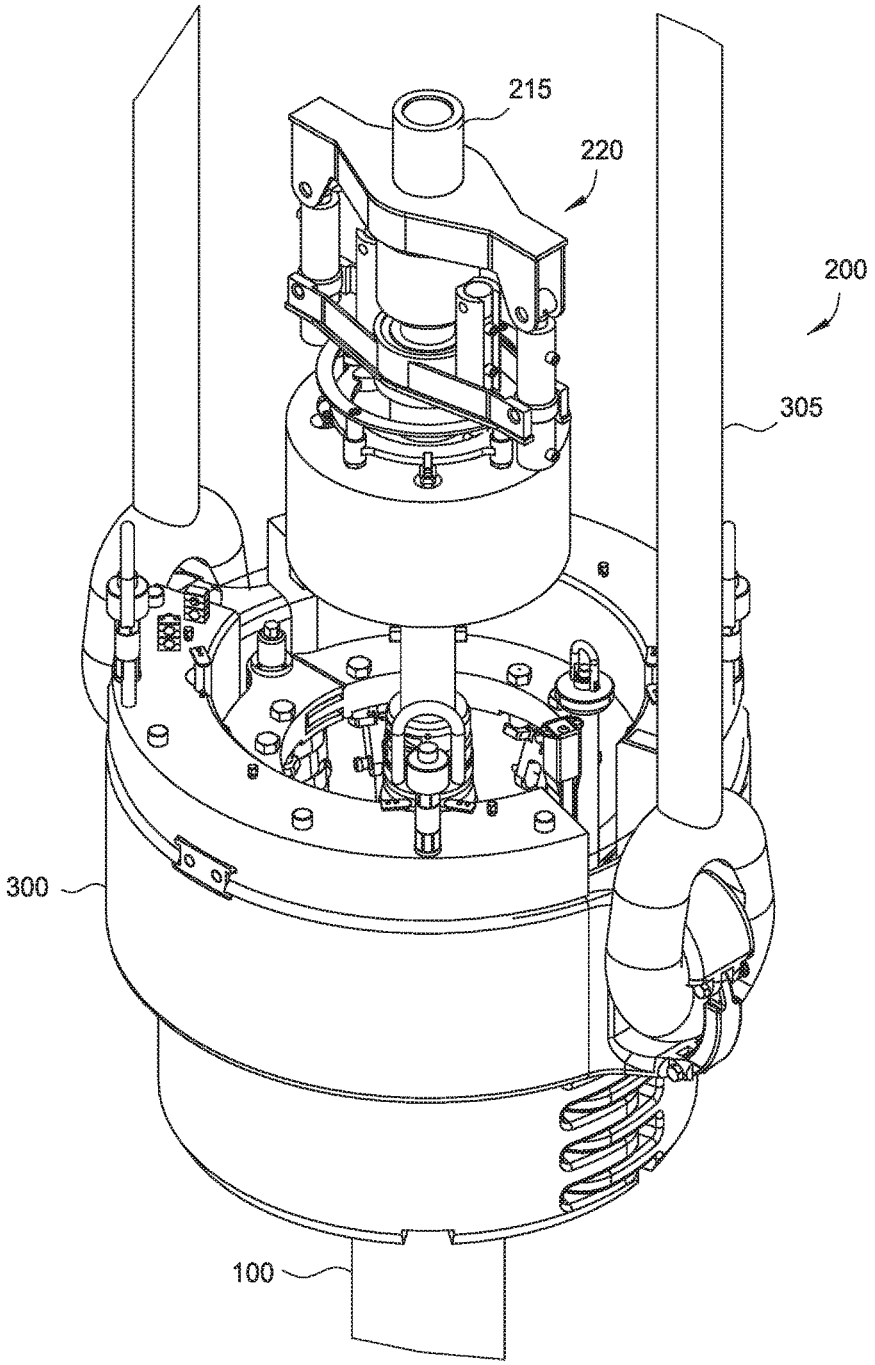
FIG. 3 illustrates a compensation/fill up assembly and an elevator according to one embodiment.

FIG. 3 illustrates one embodiment of the assembly 200, including the compensator/fill up assembly 220 and the elevator 300. As illustrated, the elevator 300 may support the tubular string 100. The elevator 300 may be coupled to the traveling member 205, such as a top drive, by bails 305.

Figure 4A:
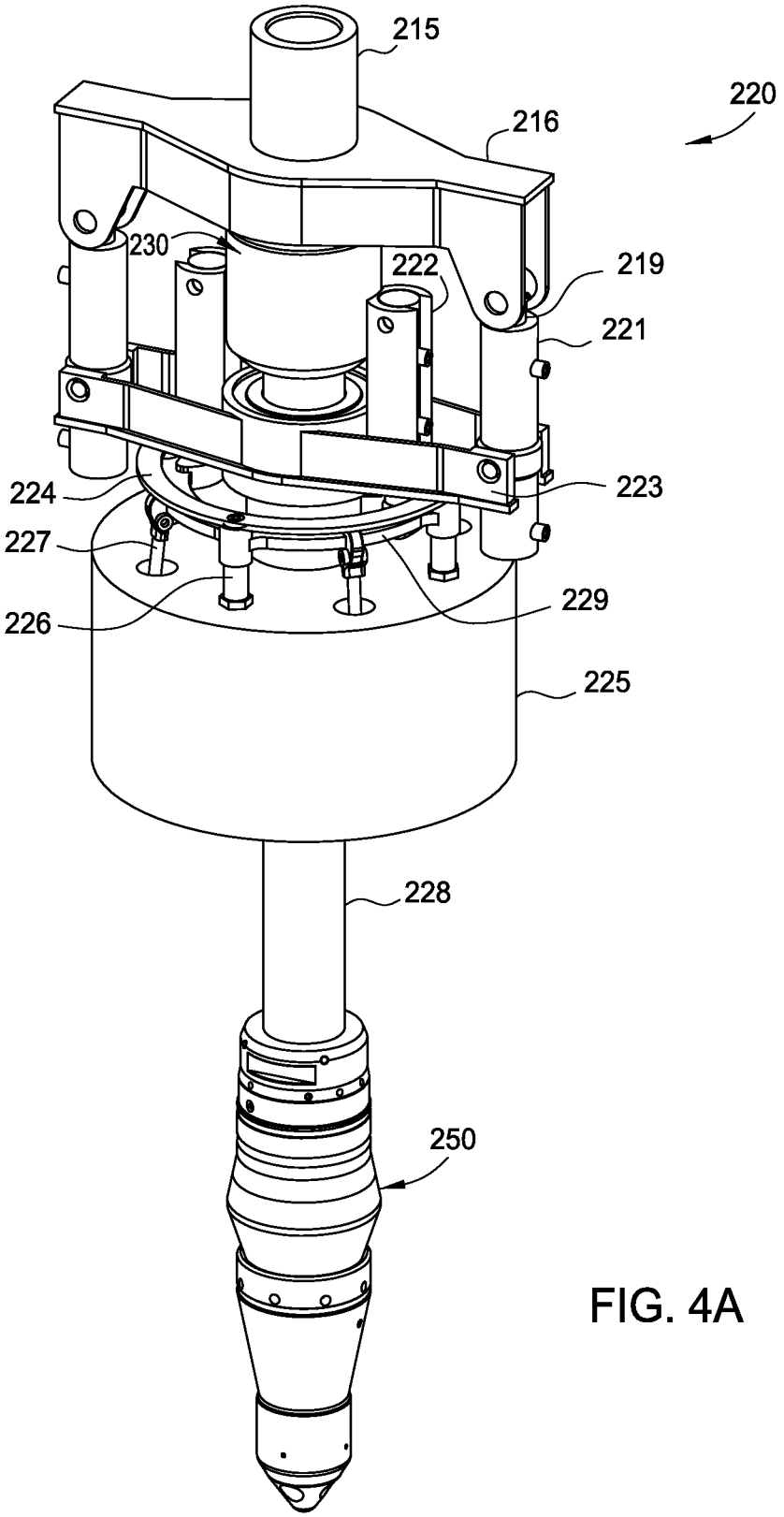
FIGS. 4A and 4B illustrate the compensation/fill up assembly in a retracted position according to one embodiment.
Figure 4B:
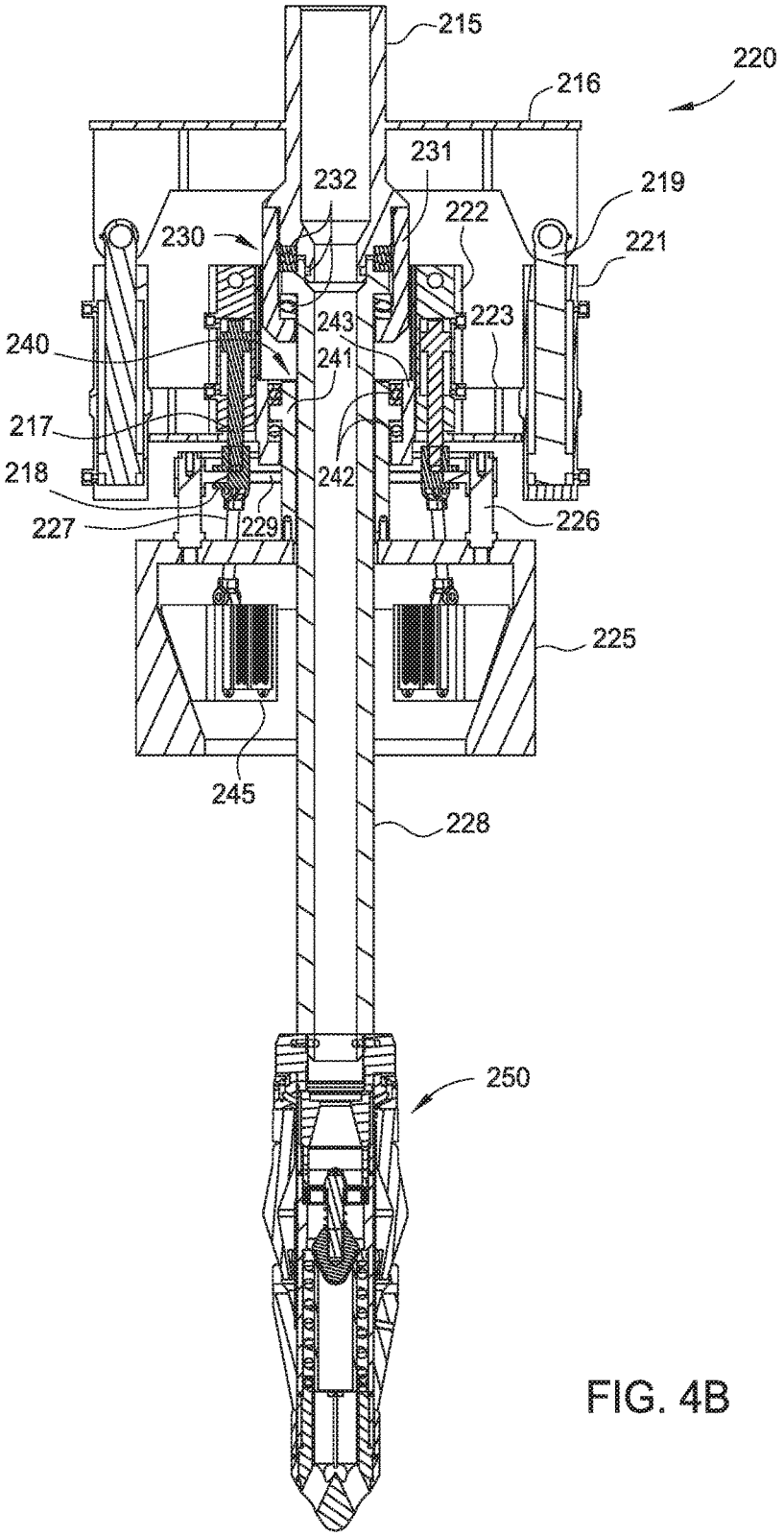

FIGS. 4A and 4B illustrate one embodiment of the compensator/fill up assembly 220 in an un-actuated, retracted position. The compensator/fill up assembly 220 may include the adapter sub 215 and an upper frame 216 that is integral with or coupled to the adapter sub 215. Compensation cylinders 221 are supported by a middle frame 223, and are coupled to the upper frame 216 by piston rods 219. The middle frame 223 also supports slip cylinders 222, which are operable to actuate a leveling ring 229 via piston rods 217. Although two compensation cylinders 221 and piston rods 219, and two slip cylinders 222 and piston rods 217 are illustrated in FIGS. 4A and 4B, the embodiments of the invention may include a single concentric, compensation and/or slip piston/cylinder assembly for compensating for the weight of the tubular 101 and/or for actuating the slip assembly to grip the tubular 101. Additional embodiments include two or more compensation and/or slip piston/cylinder assemblies.

The leveling ring 229 is operable to actuate one or more slips 245 supported in a slip housing 225. The slips 245 may be coupled to the leveling ring 229 by slip rods 227. Axial movement of the leveling ring 229 raises and lowers the slips 245 (via the slip rods 227) along a tapered inner surface of the slip housing 225. The slips 245 thus may be moved radially inward into engagement with the tubular 101 when directed into an opening in the lower end of the slip housing 225. Other similar slip-type assemblies known in the art may be used with the embodiments described herein.

A support ring 224 and guide pins 226 may be provided to stabilize and maintain the leveling ring 229 in a level position as it is raised and lowered during operation. The piston rods 217 may be coupled to the leveling ring 229 by a bearing member 218. The bearing member 218 enables rotation of the slips 245, slip housing 225, support ring 224, guide pins 226, and leveling ring 229 relative to the middle frame 223, slip cylinders 222, piston rods 217, compensation cylinders 221, piston rods 219, and upper frame 216 as further described below. Other bearing-type assemblies known in the art may be used with the embodiments described herein.

The compensator/fill up assembly 220 may further include a fluid swivel 230 and a swivel joint 240. The fluid swivel 230 may include an outer mandrel 231 coupled to the lower end of the adapter sub 215. One or more bearings/seals 232 may be supported within the outer mandrel 231 between the lower end of the adapter sub 215 and the upper end of a fluid shaft 228. The upper end of the fluid shaft 228 may sealingly engage the lower end of the adapter sub 215 within the outer mandrel 231. The fluid swivel 230 provides a sealed and rotational interface between the adapter sub 215 and the fluid shaft 228.

The fluid shaft 228 may extend through the swivel joint 240 and the slip housing 225 for connection to a fill up tool 250. The swivel joint 240 may include an inner sleeve 241 that is coupled to or integral with the slip housing 225, and an outer sleeve 243 that is coupled to or integral with the middle frame 223. One or more bearings 242 may be disposed between a shoulder formed on the inner sleeve 241 and the outer sleeve 243. The fluid shaft 228 may extend through the inner sleeve 241. The swivel joint 240 provides a rotational interface between the outer sleeve 243 and the fluid shaft 228.

The fill up tool 250 may be coupled to the lower end of the fluid shaft 228. The fill up tool 250 may be inserted into a tubular, and may include external sealing elements, such as packer cups, to form a seal with the inner surface of the tubular. The fill up tool 250 may include internal flow control valves for controlling fluid flow through the bore of the fill up tool 250 and into the tubular string. The fill up tool 250 may include any tool known in the art that is operable to control and direct the supply of drilling fluid or other similar working fluids into the tubular string 100. An exemplary fill up tool is illustrated and described in U.S. Pat. No. 8,141,642, the contents of which are herein incorporated by reference in its entirety.

Figure 5A:
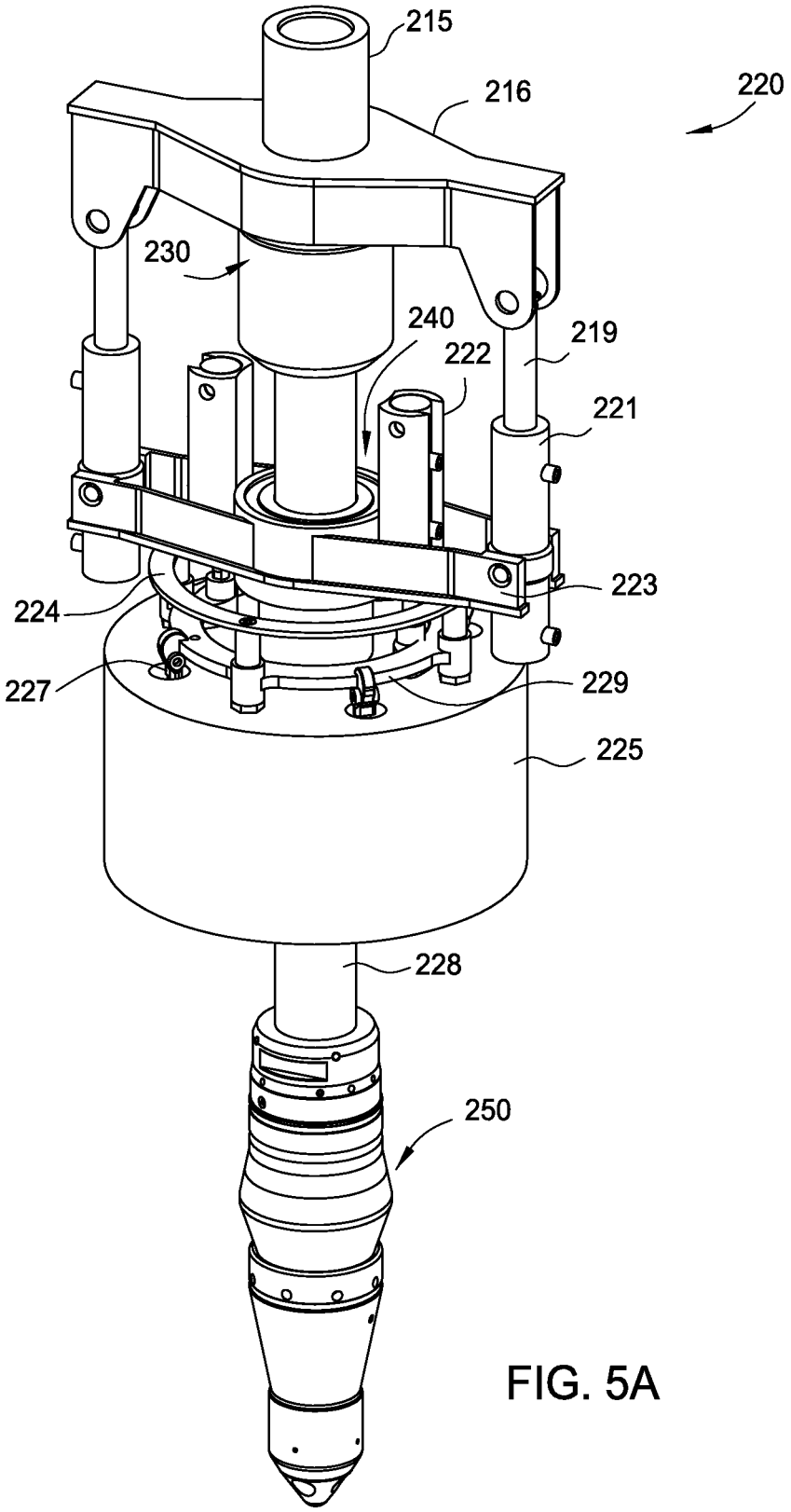
FIGS. 5A and 5B illustrate the compensation/fill up assembly in an extended position according to one embodiment.
Figure 5B:
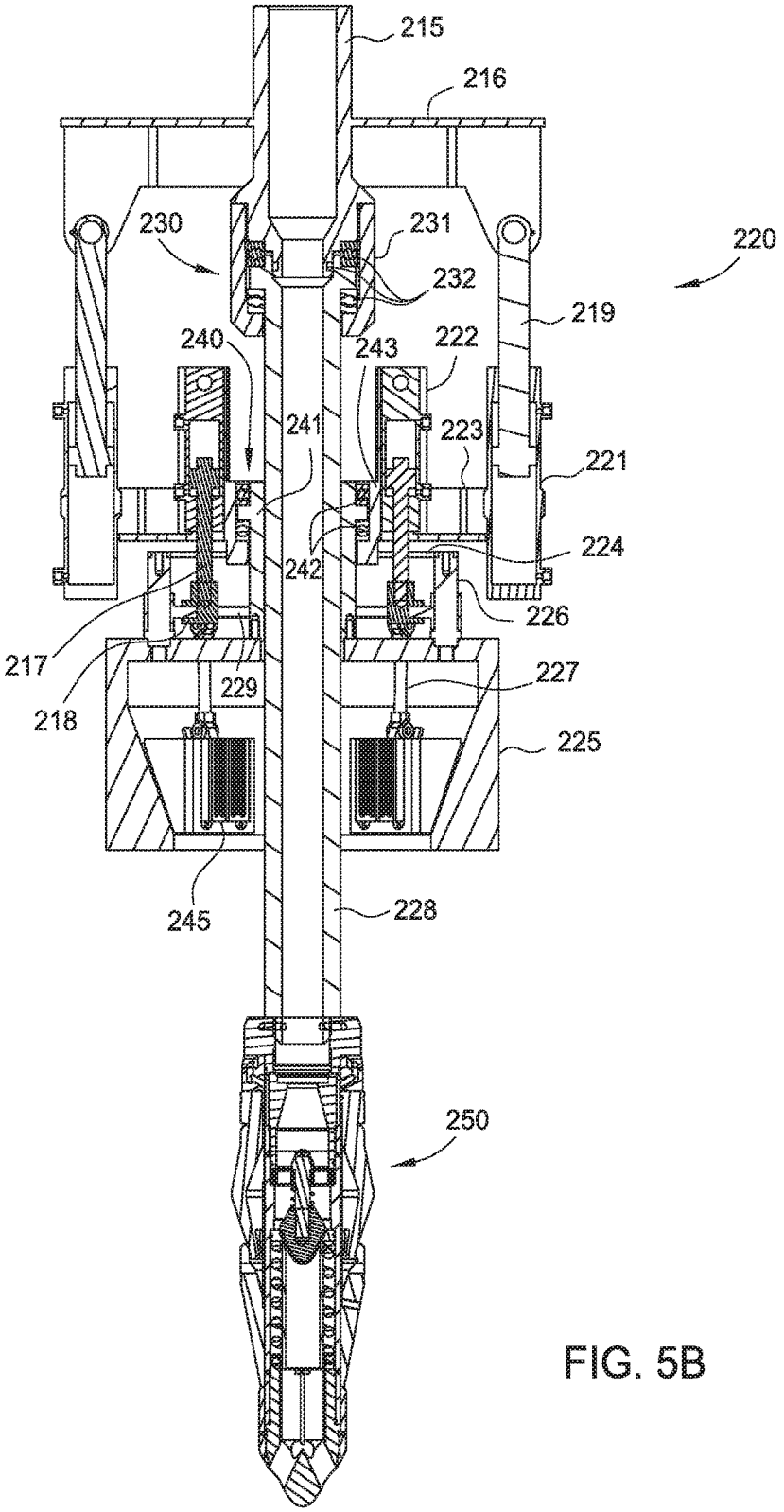

FIGS. 5A and 5B illustrate one embodiment of the compensator/fill up assembly 220 in an actuated, extended position. During operation, the compensator/fill up assembly 220 may be lowered by the traveling member 205 into engagement with the tubular 101 that is supported by the handling system 30 (as illustrated in FIG. 1), another elevator, or some other similar tubular handling tool. In particular, the compensator/fill up assembly 220 is lowered until the fill up tool 250 is inserted into the tubular 101 and the upper end of the tubular 101 is positioned within the slip housing 225. The solid fluid shaft 228 helps push the fill up tool 250 into the tubular 101 so that the upper end of the tubular may be positioned within the slip housing 225. Then, the slip cylinders 222 are pressurized to extend the piston rods 217 and thereby lower the leveling ring 229 and slip rods 227 to move the slips 245 radially inward into engagement with the tubular 101. In one embodiment, the compensator/fill up assembly 220 may include a camera or other tubular indication device to control and/or verify proper positioning of the upper end of the tubular 101 in the slip housing 225 for engagement by the slips 245.

When engaged by the slips 245, the weight of the tubular 101 may be supported by the compensation cylinders 221. The weight of the tubular 101 may be transferred to the compensation cylinders 221 through the slips 245, the slip rods 227, the slip housing 225, the leveling ring 229, the piston rods 217, the slip cylinders 222, and the middle frame 223. The compensation cylinders 221 are compressed by the weight of the tubular 101 and move in a downward direction. The piston rods 219 are shown in an extended position relative to the compensation cylinders 221 in FIGS. 5A and 5B.

With the weight of the tubular 101 supported by the compensation cylinders 221, the traveling member 205 may move the compensator/fill up assembly 220 and the tubular 101 into position for threaded connection with the tubular string 100. The compensation cylinders 221 help reduce the amount of tubular weight that is set down on the threads between the pin end 103 of the tubular 101 and the box end 104 of the tubular string 100. Also, the compensation cylinders 221 help increase the amount of torque put into making up the threaded connection by reducing the amount needed to overcome sliding friction.

The rotation mechanism 25 (schematically illustrated in FIG. 1) may rotate the tubular 101 to make up the threaded connection. During make up, the compensation cylinders 221 may also compensate for the downward travel of the tubular 101 due to the threaded make up to the tubular string 100. Further, during make up, the fluid swivel 230 allows the fill up tool 250 to rotate with the tubular 101. In particular, the fill up tool 250 is coupled to the fluid shaft 228, which rotates against the bearings 232 relative to the outer mandrel 231, the adapter sub 215, and the upper frame 216. Excessive wear on the sealing elements of the fill up tool 250 is minimized by allowing rotation of the fill up tool 250 with the tubular 101.

In addition, the swivel joint 240 and the bearing member 218 allow the slip housing 225, the slips 245 (when engaged with the tubular 101), and the leveling ring 229 to rotate with the tubular 101. In particular, the slip housing 225 is coupled to or integral with the inner sleeve 241, which rotates against the bearings 242 relative to the outer sleeve 243, which is coupled to or integral with the middle frame 223. The middle frame 223 supports the slip cylinders 222 and piston rods 217. Rotation of the slip housing 225 also rotates the slips 245, the slip rods 227, the guide pins 226, the support ring 224, and the leveling ring 229. The bearing member 218 allows the leveling ring 229 to rotate relative to the slip cylinders 222 and the piston rods 217. Thus, when the compensator/fill up assembly 220 supports the tubular 101, the slips 245, the slip housing 225, and the leveling ring 229 may rotate with the tubular 101.

Once the threaded connection of the tubular 101 to the tubular string 100 is complete, the elevator 300 may engage the tubular string 100, which now includes the tubular 101. The compensator/fill up assembly 220 may disengage the tubular 101, and the gripping apparatus 20 may disengage the tubular string 100, such that the entire load of the tubular string 100 is supported by the elevator 300. Although not supporting the weight of the tubular string 100, the fill up tool 350 may still be inserted into the tubular 101. The traveling member 205 may lower the tubular string 100 so that the box end 104 is near the rig floor 10. The gripping apparatus 20 then engages the tubular string 100 and the elevator 300 disengages the tubular string 100. The traveling member 205 lifts the assembly 200 and the process may be repeated until the tubular string 100 is the desired length.

Drilling fluid or other similar working fluids may be supplied through the bore of the traveling member 205, the adapter sub 215, the fluid shaft 228, and/or the fill up tool 250 into the tubular string 100 once the threaded connection to the tubular 101 is complete. Drilling fluid or other similar working fluids may be supplied into the tubular string 100 as it is being lowered by the traveling member 205. The tubular string 100 also may be rotated as it is being lowered by the traveling member 205. As discussed above, the fluid swivel 230 enables rotation of the fluid shaft 228 and the fill up tool 250 with the tubular string 100 to minimize wear of the sealing elements of the fill up tool 250.

Figure 6A:
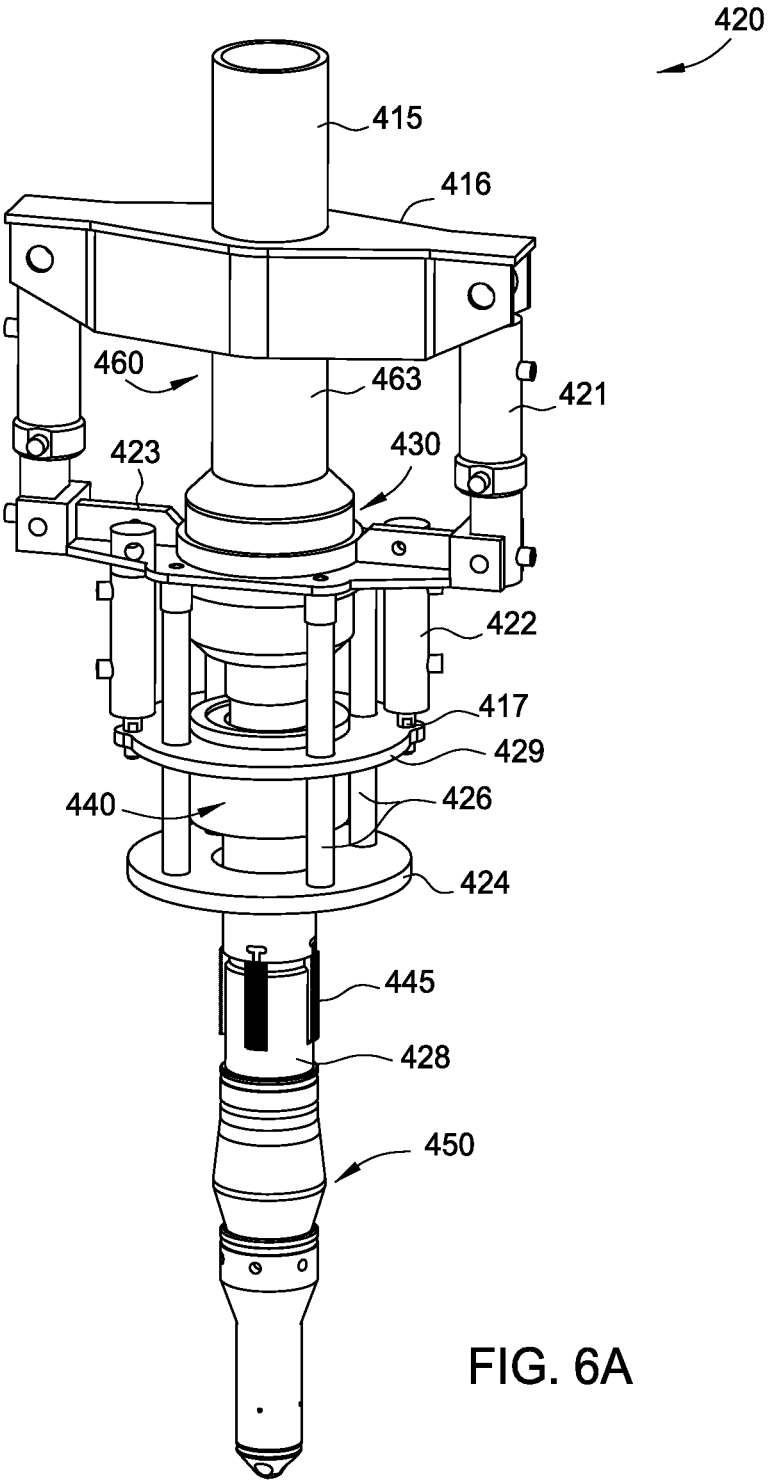
FIGS. 6A and 6B illustrate the compensation/fill up assembly in a retracted position according to one embodiment.
Figure 6B:
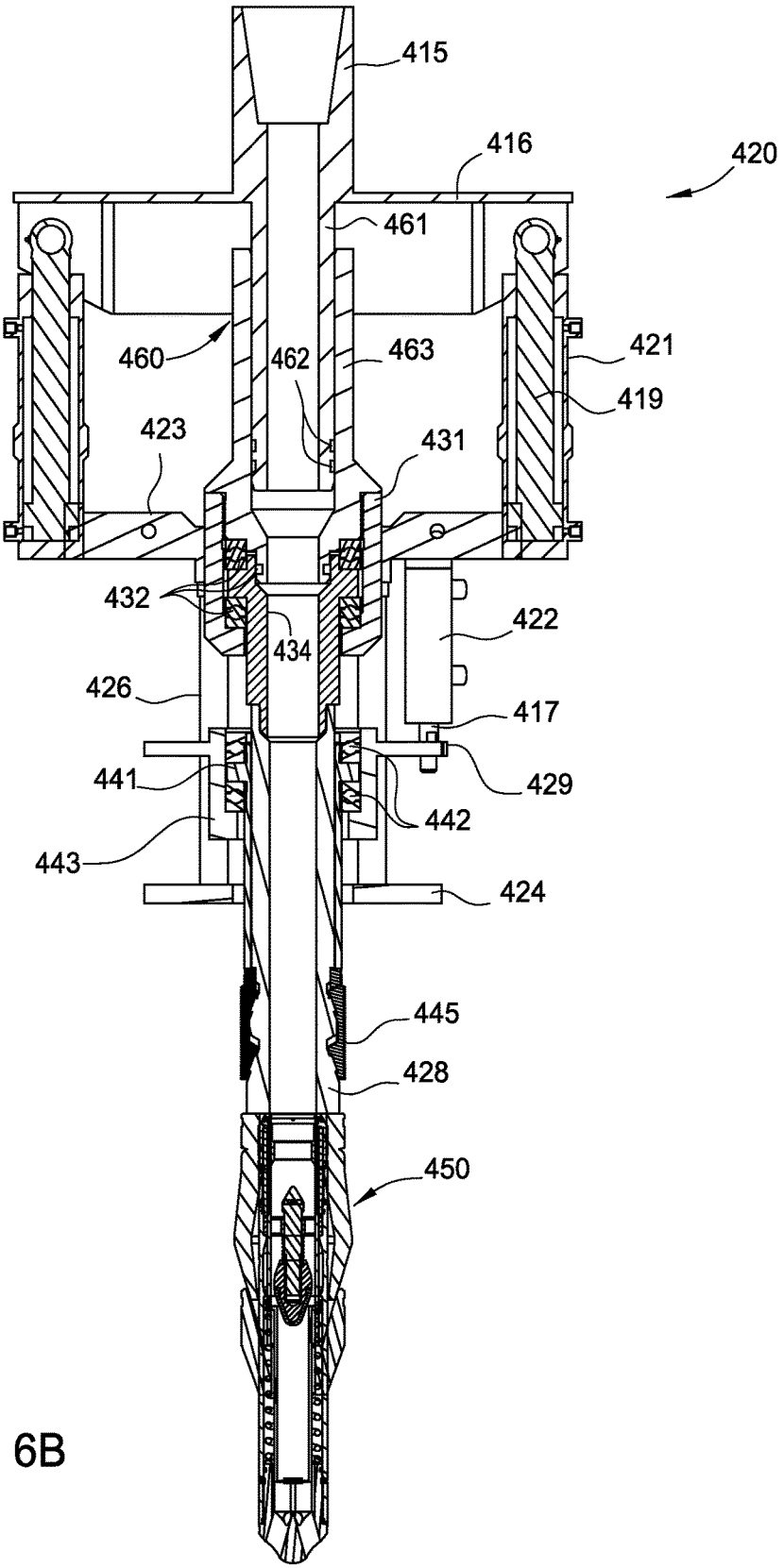

FIGS. 6A and 6B illustrate one embodiment of a compensator/fill up assembly 420 in an un-actuated, retracted position. The compensator/fill up assembly 420 is similar to the compensator/fill up assembly 220 described above, the full operation of which is omitted for brevity. Components of the compensator/fill up assembly 420 that are similar to the compensator/fill up assembly 220 may include similar reference numerals but with a 400-series designation.

The compensator/fill up assembly 420 may include an adapter sub 415 for connection to the traveling member 205 (such as a top drive), and an upper frame 416 that is integral with or coupled to the adapter sub 415. Compensation cylinders 421 are supported by a middle frame 423, and are coupled to the upper frame 416 by piston rods 419. The middle frame 423 also supports slip cylinders 422, which are operable to actuate a leveling ring 429 via piston rods 417. Although two compensation cylinders 421 and piston rods 419, and two slip cylinders 422 and piston rods 417 are illustrated in FIGS. 6A and 6B, the embodiments of the invention may include a single concentric, compensation and/or slip piston/cylinder assembly for compensating for the weight of the tubular 101 and/or for actuating the slip assembly to grip the tubular 101. Additional embodiments include two or more compensation and/or slip piston/cylinder assemblies.

The leveling ring 429 is operable to actuate one or more slips 445 that are axially movable along the outer surface of a fluid shaft 428 via a swivel joint 440. The slips 445 may be coupled to an inner sleeve 441 that is axially coupled to an outer sleeve 443 of the swivel joint 440. The outer sleeve 443 may be integral with or coupled to the leveling ring 429. Axial movement of the leveling ring 429 raises and lowers the inner sleeve 441 and thus the slips 445 along outer tapered shoulders of the fluid shaft 428. The slips 445 may be positioned within and moved radially outward into engagement with the inner surface of the tubular 101. A support ring 424 and guide pins 426 may be provided to stabilize and maintain the leveling ring 429 in a level position as it is raised and lowered during operation. In one embodiment, the piston rods 417 may be coupled to the leveling ring 429 by a bearing member, such as bearing member 218, to enable rotation of the leveling ring 429 relative to the piston rods 417.

The compensator/fill up assembly 220 may further include a slip joint 460, a fluid swivel 430 and a swivel joint 440. The slip joint 460 may include an inner sleeve 461 (coupled to or integral with the upper frame 416 and/or the adapter sub 416), an outer sleeve 463, and one or more seals 462 disposed between the inner and outer sleeves. The fluid swivel 430 may be supported by the middle frame 423, and may include an outer mandrel 431 coupled to the lower end of the outer sleeve 463. One or more bearings/seals 432 may be supported within the outer mandrel 431 between the lower end of the outer sleeve 463 and the upper end of an inner mandrel 434. The upper end of the inner mandrel 434 may sealingly engage the lower end of the outer sleeve 463 within the outer mandrel 231. The lower end of the inner mandrel 434 may be coupled to the upper end of the fluid shaft 428. The fluid swivel 430 provides a sealed and rotational interface between the slip joint 460 and the fluid shaft 428.

The fluid shaft 428 may extend through the swivel joint 440 for connection to a fill up tool 450, such as fill up tool 250. The swivel joint 440 may include the inner and outer sleeves 441, 443, and one or more bearings 442 disposed between a shoulder formed on the inner sleeve 441 and the outer sleeve 443 (which may be integral with the leveling ring 429). The fluid shaft 228 may extend through the inner sleeve 441. The swivel joint 440 provides a rotational interface but axial coupling between the inner sleeve 441 and the outer sleeve 443.

Figure 7A:
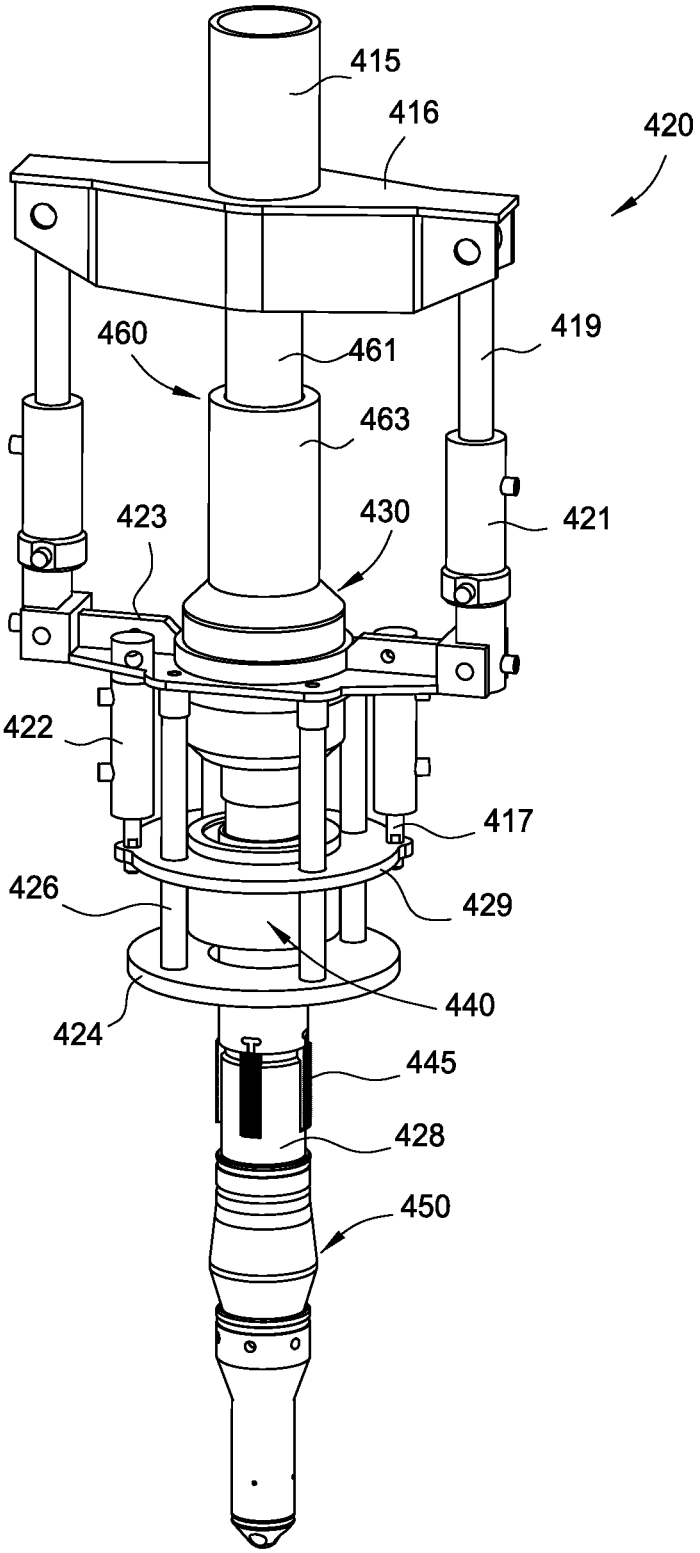
FIGS. 7A and 7B illustrate the compensation/fill up assembly in an extended position according to one embodiment.
Figure 7B:
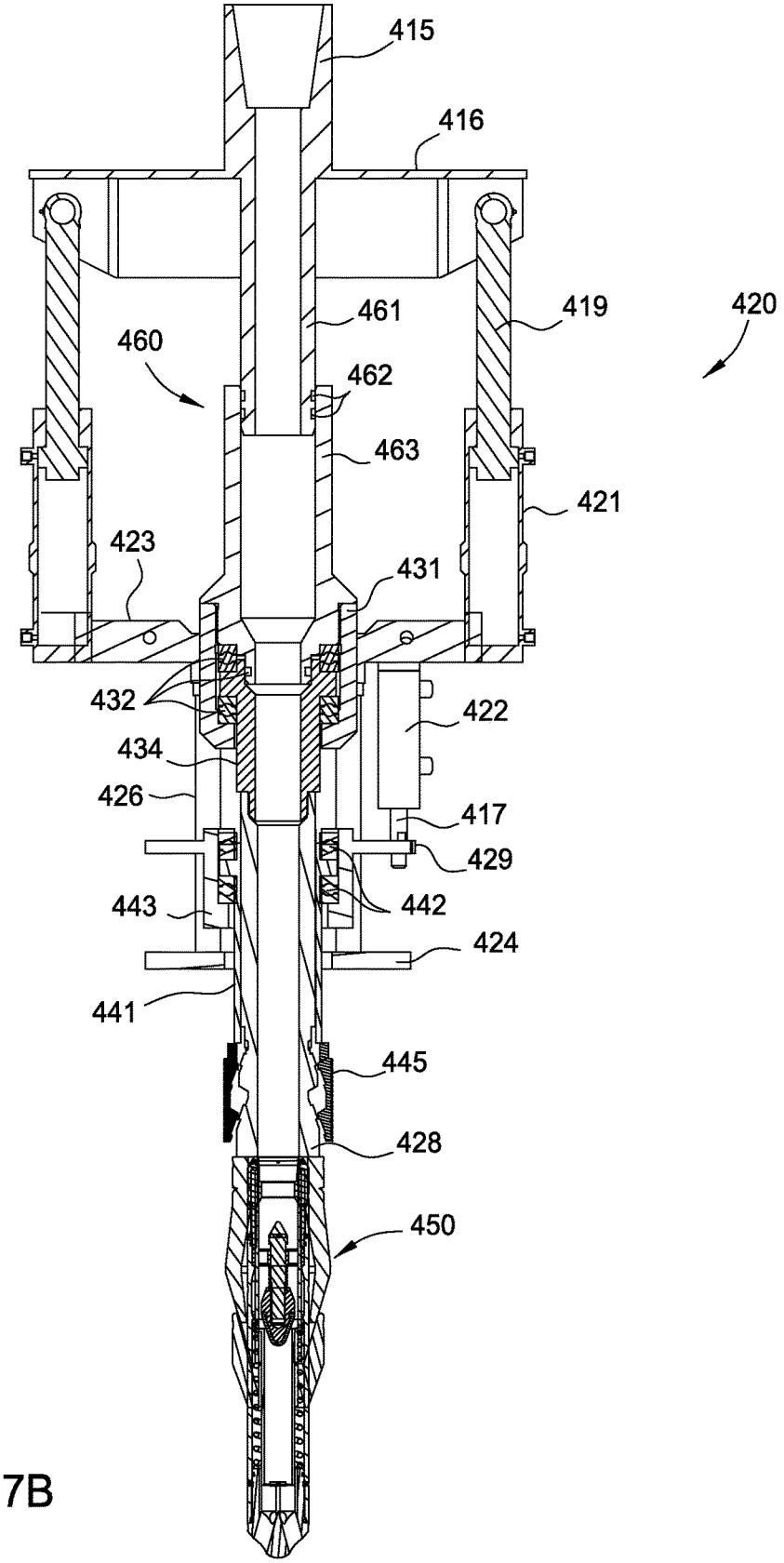

FIGS. 7A and 7B illustrate one embodiment of the compensator/fill up assembly 420 in an actuated, extended position. During operation, the compensator/fill up assembly 420 may be lowered by the traveling member 205 until the fill up tool 450 and the slips 445 are inserted into the tubular 101. The upper end of the tubular 101 may be stopped by the support ring 424 with the compensation cylinders 421 in the retracted position. Then, the slip cylinders 422 are pressurized to extend the piston rods 417 and thereby lower the leveling ring 429 and the inner sleeve 441 to move the slips 445 radially outward into engagement with the tubular 101.

When engaged by the slips 445, the weight of the tubular 101 may be supported by the compensation cylinders 421. The weight of the tubular 101 may be transferred to the compensation cylinders 421 through the slips 445, the slip joint 440, the leveling ring 429, the piston rods 417, the slip cylinders 422, and the middle frame 423. The compensation cylinders 421 are compressed by the weight of the tubular 101 and move in a downward direction. The piston rods 419 are shown in an extended position relative to the compensation cylinders 421 in FIGS. 7A and 7B. The slip joint 460 compensates for the downward movement of the compensation cylinders 421 relative to the upper frame 416. In particular, the outer sleeve 463 (which is coupled to the middle frame 423 via the slip joint 430) slides downward relative to the inner sleeve 461 (which is coupled to or integral with the upper frame 416).

With the weight of the tubular 101 supported by the compensation cylinders 421, the traveling member 205 may move the compensator/fill up assembly 420 and the tubular 101 into position for threaded connection with the tubular string 100. The compensation cylinders 421 help reduce the amount of tubular weight that is set down on the threads between the pin end 103 of the tubular 101 and the box end 104 of the tubular string 100. Also, the compensation cylinders 421 help increase the amount of torque put into making up the threaded connection by reducing the amount needed to overcome sliding friction.

The rotation mechanism 25 (schematically illustrated in FIG. 1) may rotate the tubular 101 to make up the threaded connection. During make up, the compensation cylinders 421 may also compensate for the downward travel of the tubular 101 due to the threaded make up to the tubular string 100. Further, during make up, the fluid swivel 430 allows the fill up tool 450 to rotate with the tubular 101. In particular, the fill up tool 450 is coupled to the fluid shaft 428, which is coupled to the inner mandrel 434 and rotates against the bearings 432 relative to the outer mandrel 431. Excessive wear on the sealing elements of the fill up tool 450 is minimized by allowing rotation of the fill up tool 450 with the tubular 101.

In addition, the swivel joint 440 allow the slips 445 (when engaged with the tubular 101) and the inner sleeve 441 to rotate with the tubular 101. In particular, the inner sleeve 441, which rotates against the bearings 442 relative to the outer sleeve 443, which is coupled to or integral with the leveling ring 429.

Drilling fluid or other similar working fluids may be supplied through the bore of the traveling member 205, the adapter sub 415, the slip joint 460, the fluid swivel 430, the fluid shaft 428, and/or the fill up tool 450 into the tubular string 100 once the threaded connection to the tubular 101 is complete. Drilling fluid or other similar working fluids may be supplied into the tubular string 100 as it is being lowered by the traveling member 205. The tubular string 100 also may be rotated as it is being lowered by the traveling member 205. As discussed above, the fluid swivel 430 enables rotation of the fluid shaft 428 and the fill up tool 450 with the tubular string 100 to minimize wear of the sealing elements of the fill up tool 450.

Figure 8A:
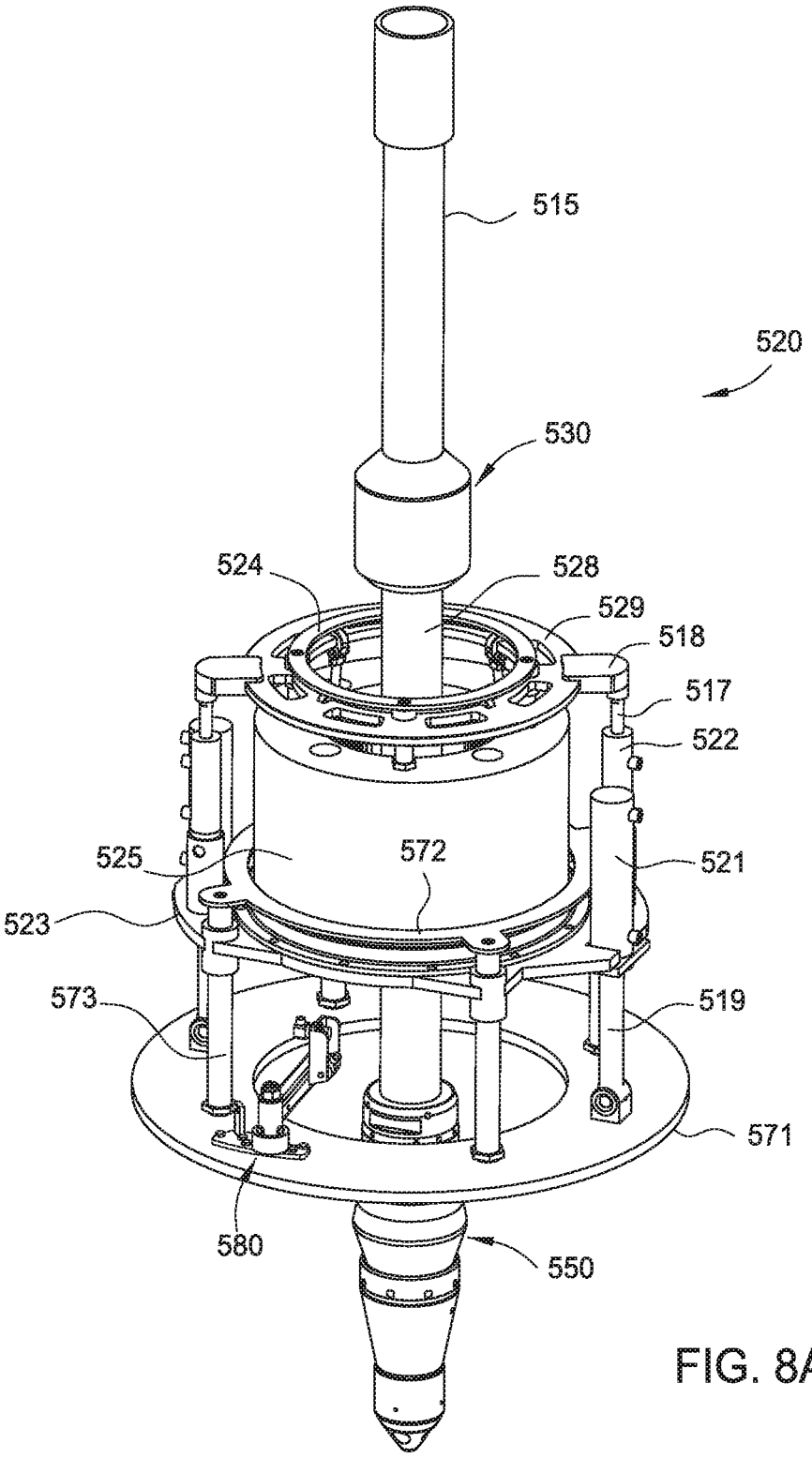
FIGS. 8A and 8B illustrate the compensation/fill up assembly in an extended position according to one embodiment.
Figure 8B:
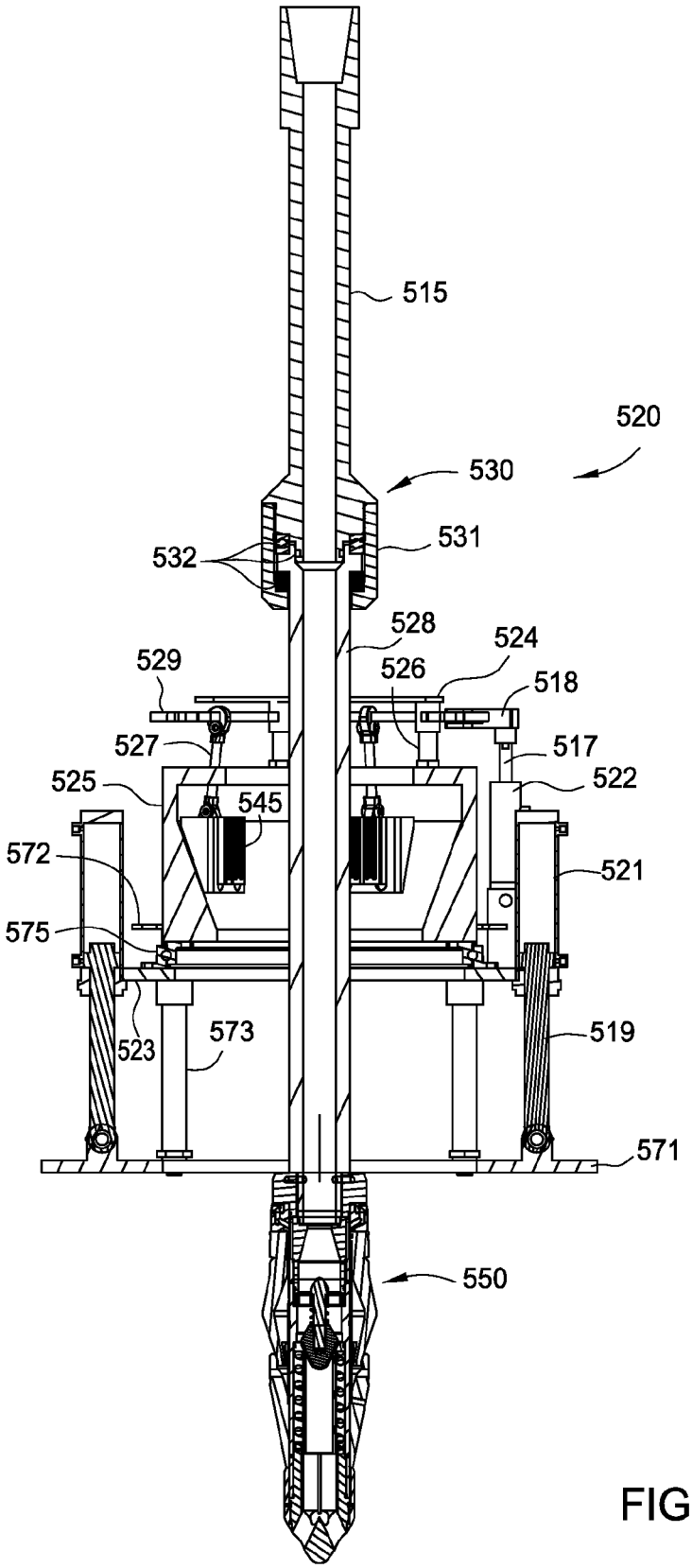

FIGS. 8A and 8B illustrate one embodiment of a compensator/fill up assembly 520 in an extended position. The compensator/fill up assembly 520 is similar to the compensator/fill up assemblies 220, 420 described above, the full operation of which is omitted for brevity. Components of the compensator/fill up assembly 520 that are similar to the compensator/fill up assemblies 220, 420 may include similar reference numerals but with a 500-series designation.

The compensator/fill up assembly 520 includes a base plate 571 for setting a portion of the assembly 520 on top of the elevator 300 (illustrated in FIG. 3) to utilize the strength of the elevator 300 frame to support the assembly 520 and to transfer load through the bails 305 (illustrated in FIG. 3) connected to the traveling member 205. The compensator/fill up assembly 520 further includes compensation cylinders 521 that are supported by a middle frame 523, and that are coupled to the base plate 571 by piston rods 519. A support ring 571 is coupled to the base plate 571 via guide pins 573. The middle frame 523 is movable along the guide pins 573 upon operation of the compensation cylinders 521. Although two compensation cylinders 521 and piston rods 519, and two slip cylinders 522 and piston rods 517 are illustrated in FIGS. 8A and 8B, the embodiments of the invention may include a single concentric, compensation and/or slip piston/cylinder assembly for compensating for the weight of the tubular 101 and/or for actuating the slip assembly to grip the tubular 101. Additional embodiments include two or more compensation and/or slip piston/cylinder assemblies.

The middle frame 523 also supports slip cylinders 522, which are operable to actuate a leveling ring 529 via piston rods 517. The leveling ring 529 is operable to actuate one or more slips 545 supported in a slip housing 525. The slips 545 may be coupled to the leveling ring 529 by slip rods 527. Axial movement of the leveling ring 529 raises and lowers the slips 545 (via the slip rods 527) along a tapered inner surface of the slip housing 525. The slips 545 thus may be moved radially inward into engagement with the tubular 101 when positioned through an opening in the lower end of the slip housing 525. A support ring 524 and guide pins 526 may be provided to stabilize and maintain the leveling ring 529 in a level position as it is raised and lowered during operation.

The piston rods 517 may be coupled to the leveling ring 529 by a bearing member 518. In addition, the slip housing 525 is disposed on a bearing member 575. The bearing members 518, 575 enable rotation of the slips 545, slip housing 525, support ring 524, guide pins 526, and leveling ring 529 relative to the middle frame 523, slip cylinders 522, piston rods 517, compensation cylinders 521, piston rods 519, and base plate 571. Thus, the bearing members 518, 575 allow the slip housing 225, the slips 245 (when engaged with the tubular 101), and the leveling ring 529 to rotate with the tubular 101.

The compensator/fill up assembly 520 may further include a fluid swivel 530 that is supported by the traveling member 205 via an adapter sub 515. The fluid swivel 530 may include an outer mandrel 531 coupled to the lower end of the adapter sub 515 for connection to the traveling member 205, which may be a top drive. One or more bearings/seals 532 may be supported within the outer mandrel 251 between the lower end of the adapter sub 515 and the upper end of a fluid shaft 528. The upper end of the fluid shaft 528 may sealingly engage the lower end of the adapter sub 515 within the outer mandrel 531. The fluid swivel 530 provides a sealed and rotational interface between the adapter sub 515 and the fluid shaft 528. The fluid shaft 528 may extend through the slip housing 525 for connection to a fill up tool 550, such as the fill up tools 250, 450.

Figure 9A:
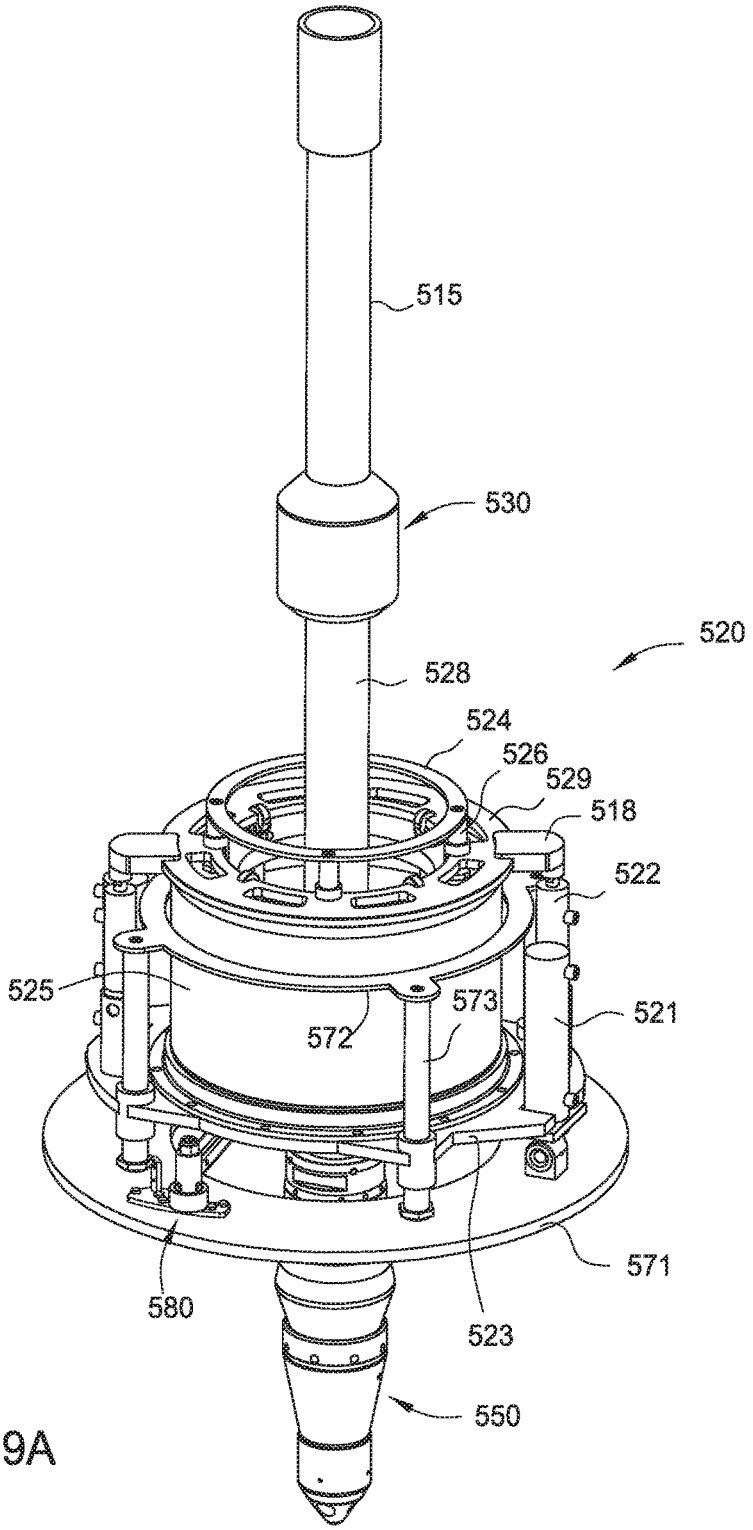
FIGS. 9A and 9B illustrate the compensation/fill up assembly in a retracted position according to one embodiment.
Figure 9B:
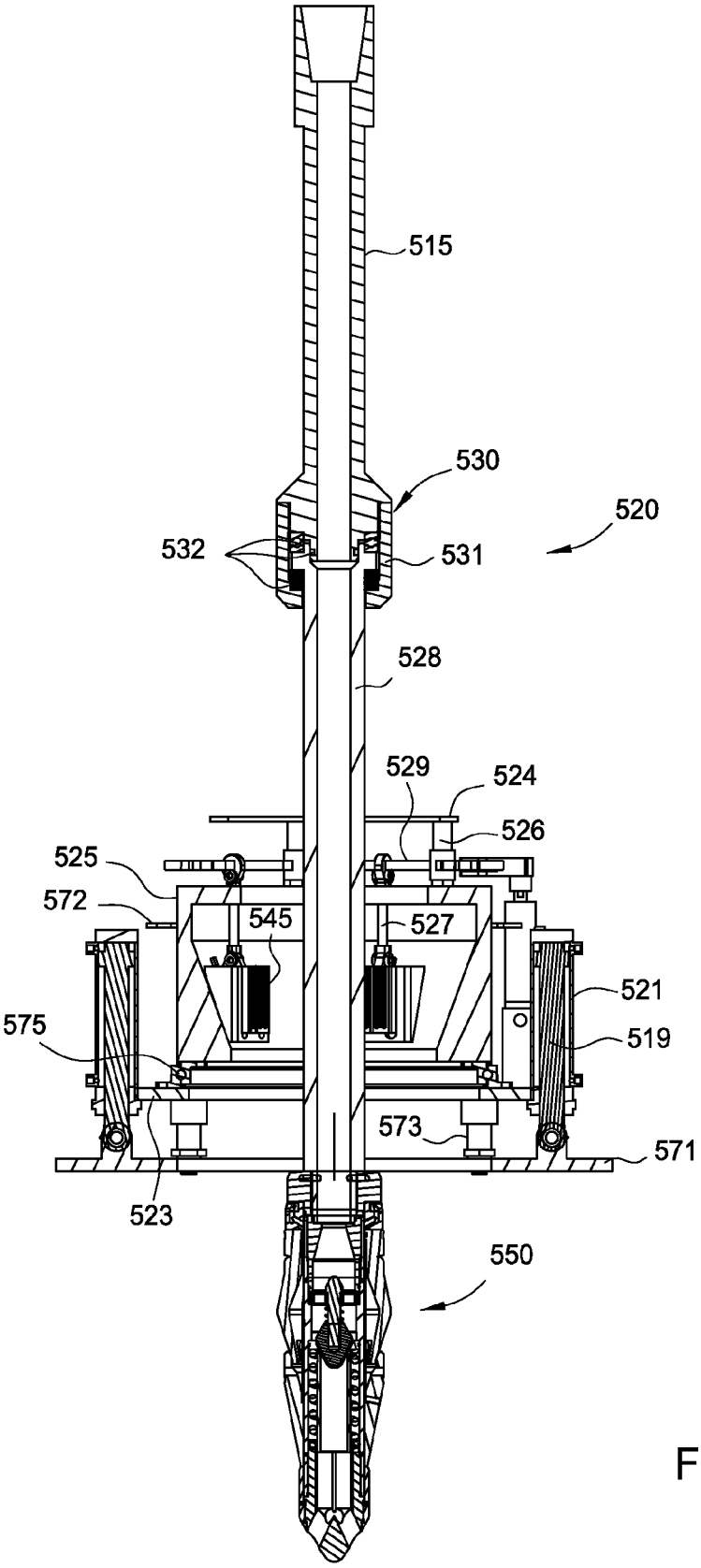

FIGS. 9A and 9B illustrate one embodiment of the compensator/fill up assembly 520 in a retracted position. During operation, the compensator/fill up assembly 520 and the elevator 300 may be lowered by the traveling member 205 into engagement with the tubular 101. In particular, the compensator/fill up assembly 520 is lowered until the fill up tool 550 is inserted into the tubular 101 and the upper end of the tubular 101 is positioned within the slip housing 525. Then, the slip cylinders 522 are pressurized to retract the piston rods 517 and thereby lower the leveling ring 529 and slip rods 527 to move the slips 545 radially inward into engagement with the tubular 101.

A tubular indication device 580 may be supported by the base plate 571 and may be operable to provide an indication of the position of the tubular 101 relative to the slips 545, the slip housing 525, the middle frame 523, and/or the base plate 571. The tubular indication device 580 may be used to control and/or verify proper positioning of the upper end of the tubular 101 in the slip housing 525 for engagement by the slips 545. The tubular indication device 580 may include a pneumatic, hydraulic, and/or electronic sensing arm that is movable from a primary position to one or more secondary positions by the tubular 101 to generate a signal corresponding to the position of the tubular 101. The tubular indication device 580 may include any proximity-type sensor known in the art, an example including a wheel that rotates along the outer surface of the tubular 101 as the tubular 101 moves past the sensor to generate a signal corresponding to the position of the tubular 101.

When engaged by the slips 545, the weight of the tubular 101 may be supported by the compensation cylinders 521. The weight of the tubular 101 may be transferred to the compensation cylinders 521 through the slips 545, the slip housing 525, the bearing member 575, and the middle frame 523. The compensation cylinders 521 are compressed by the weight of the tubular 101 and move in a downward direction. The piston rods 519 are shown in a retracted position relative to the compensation cylinders 521 in FIGS. 9A and 9B.

With the weight of the tubular 101 supported by the compensation cylinders 521, the traveling member 505 may move the compensator/fill up assembly 520, the elevator 300, and the tubular 101 into position for threaded connection with the tubular string 100. The compensation cylinders 521 help reduce the amount of tubular weight that is set down on the threads between the pin end 103 of the tubular 101 and the box end 104 of the tubular string 100. Also, the compensation cylinders 521 help increase the amount of torque put into making up the threaded connection by reducing the amount needed to overcome sliding friction.

The rotation mechanism 25 (schematically illustrated in FIG. 1) may rotate the tubular 101 to make up the threaded connection. During make up, the compensation cylinders 521 may also compensate for the downward travel of the tubular 101 due to the threaded make up to the tubular string 100. Further, during make up, the fluid swivel 530 allows the fill up tool 550 to rotate with the tubular 101. In particular, the fill up tool 550 is coupled to the fluid shaft 528, which rotates against the bearings 532 relative to the outer mandrel 531 and the adapter sub 515. Excessive wear on the sealing elements of the fill up tool 550 is minimized by allowing rotation of the fill up tool 550 with the tubular 101. In addition, the bearing members 518, 575 allow the slip housing 525, the slips 545 (when engaged with the tubular 101), and the leveling ring 529 to rotate with the tubular 101.

Once the threaded connection of the tubular 101 to the tubular string 100 is complete, the elevator 300 may engage the tubular string 100, which now includes the tubular 101. The compensator/fill up assembly 520 may disengage the tubular 101. With the tubular string 100 supported by the gripping apparatus 20, the traveling member 205 may move the elevator 300 upward until the upper end of the tubular string 100 is positioned within the elevator 300 for engagement to support the entire load of the tubular string 100. The tubular indication device 580 may be used to provide an indication that the upper end of the tubular string 100 is in the proper position for engagement by the elevator 300.

Although not supporting the weight of the tubular string 500, the fill up tool 550 may still be inserted into the tubular 101. After disengagement by the gripping apparatus 20, the traveling member 505 may lower the tubular string 100 so that the box end 104 is near the rig floor 10. The gripping apparatus 20 then engages the tubular string 100 and the elevator 300 disengages the tubular string 100. The traveling member 205 lifts the assembly 520 and the elevator 300, and the process may be repeated until the tubular string 100 is the desired length.

Drilling fluid or other similar working fluids may be supplied through the bore of the traveling member 505, the adapter sub 515, the fluid shaft 528, and/or the fill up tool 550 into the tubular string 100 during operation once the threaded connection to the tubular 101 is complete.

The compensator/fill up assemblies 220, 420, 520 may be used with one or more control elements to help control operation. One or more accumulators may be used to dampen pressure spikes during the operation of the compensation cylinders 221, 421, 521. Reducing valves may be used to limit pressure supplied to the slip cylinders 22, 422, 522 when actuated to grip the tubular 101. One or more pilots may be used to open check valves to lock the slip cylinders 22, 422, 522 and thus the slips 245, 445, 545 in open and closed positions to disengage and engage the tubular 101. An interlock may be used to prevent actuation of the slip cylinders 22, 422, 522 and thus the slips 245, 445, 545 from gripping the tubular or otherwise be moved to a closed position when supplying fluid through the fill up tools 250, 450, 550. In particular, the interlock may help prevent the slips 245, 445, 545 from getting locked on the tubular 101 while supplying fluid to the tubular 101 via the fill up tools 250, 450, 550, and also overstressing the slip assembly.

While the foregoing is directed to embodiments of the invention, other and further embodiments of the invention may be devised without departing from the basic scope thereof, and the scope thereof is determined by the claims that follow.

We claim:

1. A compensation and fill up assembly, comprising:
- a slip assembly for engaging a tubular;
- an actuator for actuating the slip assembly;
- a leveling ring coupled to the actuator, wherein the leveling ring and slip assembly are rotatable relative to the actuator;
- a compensation assembly for supporting a weight of the tubular when engaged by the slip assembly;
- a fluid swivel; and
- a fill up tool coupled to the fluid swivel by a fluid shaft, wherein the fill up tool is insertable into and rotatable with the tubular using the fluid swivel.

2. The assembly of claim 1, wherein the slip assembly includes a slip member disposed in a slip housing, wherein the slip member is coupled to the actuator by the leveling ring, and wherein the leveling ring is rotatable relative to the actuator using a bearing member.

3. The assembly of claim 2, wherein the actuator is supported by a frame, and further comprising a swivel joint supported by the frame, where the slip housing is supported by the frame by the swivel joint.

4. The assembly of claim 3, wherein the slip member, the slip housing, and the leveling ring are rotatable relative to the actuator and the frame using the bearing member and the swivel joint.

5. The assembly of claim 4, wherein the fluid shaft is disposed through the swivel joint and the slip housing.

6. The assembly of claim 1, further comprising an upper frame coupled to a middle frame by a piston/cylinder of the compensation assembly, wherein the tubular is rotatable relative to the upper frame, the middle frame, and the compensation assembly while the compensation assembly supports the weight of the tubular.

7. The assembly of claim 6, wherein the fluid swivel is supported by at least one of the upper frame and the middle frame to enable rotation of the fluid shaft, the fill up tool, and the tubular relative to the upper frame and middle frame.

8. The assembly of claim 7, further comprising a slip joint disposed between the upper frame and the middle frame and coupled to the fluid swivel.

9. The assembly of claim 8, wherein the slip assembly includes a slip member disposed on an outer tapered shoulder of the fluid shaft, wherein the slip member is coupled to the actuator by a swivel joint and the leveling ring.

10. The assembly of claim 9, wherein the slip member is rotatable relative to the actuator using the swivel joint.

11. The compensation and fill up assembly of claim 1, wherein the actuator comprises a piston and cylinder assembly.

12. A method of making up a tubular connection, comprising:
- lowering a compensation and fill up assembly into engagement with a tubular, wherein the compensation and fill up assembly comprises a slip assembly, a compensation assembly, a fluid swivel, and a fill up tool coupled to the fluid swivel by a fluid shaft;
- inserting the fill up tool into the tubular;
- actuating the slip assembly using an actuator, wherein the actuator is coupled to a leveling ring;
- engaging the tubular using the slip assembly;
- supporting a weight of the tubular using the compensation assembly; and
- rotating the tubular, the slip assembly, the fluid swivel, the leveling ring, and the fill up tool relative to the actuator to connect the tubular to a tubular string.

13. The method of claim 12, further comprising supplying a working fluid through the fluid swivel and the fill up tool into the tubular string.

14. The method of claim 13, wherein the slip assembly comprises a slip member disposed in a slip housing, and the actuator for actuating the leveling ring to move the slip member into and out of engagement with the tubular.

15. The method of claim 14, further comprising rotating the slip member, the slip housing, and the leveling ring with the tubular relative to the actuator.

16. The method of claim 13, wherein the slip assembly comprises a slip member disposed on an outer tapered surface of the fluid shaft, and the actuator for actuating the leveling ring to move the slip member into and out of engagement with the tubular.

17. The method of claim 16, further comprising rotating the slip member with the tubular relative to the actuator using a swivel joint that connects the slip member to the leveling ring.

18. The method of claim 12, further comprising sensing a position of the tubular relative to the slip assembly.

19. A compensation and fill up assembly adapted for connection to a traveling member, comprising:

a slip assembly for engaging a tubular;

an actuator for actuating the slip assembly;

a leveling ring coupled to the actuator, wherein the leveling ring and the slip assembly are rotatable relative to the actuator;

a compensation assembly for supporting a weight of the tubular when engaged by the slip assembly;

a swivel; and a fill up tool coupled to the swivel by a fluid shaft, wherein the fill up tool is insertable into and rotatable with the tubular relative to the traveling member using the swivel.

20. The assembly of claim 19, further comprising an upper frame coupled to a middle frame by a piston/cylinder of the compensation assembly, wherein the tubular is rotatable relative to the upper frame, the traveling member, the middle frame, and the compensation assembly while the compensation assembly supports the weight of the tubular.

21. A method of making up a tubular connection, comprising:

lowering a compensation and fill up assembly into engagement with a tubular using a traveling member, wherein the compensation and fill up assembly comprises a slip assembly, a compensation assembly, a swivel, and a fill up tool coupled to the swivel by a fluid shaft;

inserting the fill up tool into the tubular;

actuating the slip assembly using an actuator; wherein the actuator is coupled to a leveling ring;

engaging the tubular using the slip assembly;

supporting a weight of the tubular using the compensation assembly; and rotating the tubular, the slip assembly, the swivel, the leveling ring, and the fill up tool relative to the actuator and the traveling member to connect the tubular to a tubular string.

22. The method of claim 21, wherein the slip assembly comprises a slip member disposed in a slip housing, further comprising rotating the slip member, the slip housing, and the leveling ring with the tubular relative to the actuator and the traveling member.

23. The method of claim 21, wherein the slip assembly comprises a slip member disposed on an outer tapered surface of the fluid shaft, further comprising rotating the slip member with the tubular relative to the actuator and the traveling member.

* * * * *